US011657710B2

(12) United States Patent
Park

(10) Patent No.: US 11,657,710 B2
(45) Date of Patent: May 23, 2023

(54) DEVICE AND METHOD FOR CONTROLLING VEHICLE

(71) Applicant: HL KLEMOVE CORP., Incheon (KR)

(72) Inventor: JiYeol Park, Seoul (KR)

(73) Assignee: HL KLEMOVE CORP., Incheon (KR)

( * ) Notice: Subject to any disclaimer, the term of this patent is extended or adjusted under 35 U.S.C. 154(b) by 0 days.

(21) Appl. No.: 17/337,930

(22) Filed: Jun. 3, 2021

(65) Prior Publication Data

US 2021/0383693 A1 Dec. 9, 2021

(30) Foreign Application Priority Data

Jun. 5, 2020 (KR) ..... 10-2020-0068634

(51) Int. Cl.
*G08G 1/0967* (2006.01)
*G08G 1/0965* (2006.01)

(52) U.S. Cl.
CPC ..... *G08G 1/096725* (2013.01); *G08G 1/0965* (2013.01); *G08G 1/096775* (2013.01)

(58) Field of Classification Search
CPC ..... G08G 1/096725; G08G 1/0965; G08G 1/096775
See application file for complete search history.

(56) References Cited

U.S. PATENT DOCUMENTS

| | | | | |
|---|---|---|---|---|
| 10,896,606 | B1 * | 1/2021 | Hayes | G05D 1/0022 |
| 2015/0116133 | A1 * | 4/2015 | Mawbey | G08G 1/092 340/902 |
| 2017/0192429 | A1 * | 7/2017 | Tseng | H04W 4/02 |
| 2017/0249839 | A1 * | 8/2017 | Becker | H04W 4/90 |
| 2018/0374347 | A1 * | 12/2018 | Silver | H04R 3/005 |
| 2019/0039613 | A1 * | 2/2019 | Lee | B60W 30/0956 |
| 2019/0263410 | A1 * | 8/2019 | Groult | B60W 30/0956 |
| 2019/0359209 | A1 * | 11/2019 | Mizutani | B60W 40/06 |
| 2020/0207367 | A1 * | 7/2020 | Adireddy | G08G 1/0965 |

* cited by examiner

*Primary Examiner* — Mohamed Barakat
(74) *Attorney, Agent, or Firm* — Hauptman Ham, LLP

(57) ABSTRACT

According to the disclosure, there may be provided a vehicle control device and method and, in particular, a vehicle control device and method that allows an emergency vehicle to smoothly travel without disturbance by other vehicles by analyzing the location and driving lane of the emergency vehicle and providing a notification to vehicles in the same lane as the emergency vehicle according to a predetermined condition when the emergency vehicle approaches and allowing the vehicles to change their driving lane or to change preset variable parameter values of the driving assist system applied to the vehicle and activated.

8 Claims, 12 Drawing Sheets

DEVICE AND METHOD FOR CONTROLLING VEHICLE

CROSS-REFERENCE TO RELATED APPLICATION

This application claims priority from Korean Patent Application No. 10-2020-0068634, filed on Jun. 5, 2020, which is hereby incorporated by reference for all purposes as if fully set forth herein.

BACKGROUND

Field

Embodiments relate to a device and method for controlling a vehicle.

Description of Related Art

Emergency vehicles have the purposes of fire rescue, first aid, and minimizing personal injury or property damage due to various disasters. The time for the emergency vehicle to arrive at the site after receiving a report is directly related to saving lives. Heavy traffic, illegal parking, and reluctance to yield to emergency vehicles may delay dispatch to the site, causing serious problems in initial response.

Therefore, there is a need to provide a system that may efficiently yield or prepare to yield when an emergency vehicle approaches through active control on the driving assist system.

SUMMARY OF THE INVENTION

According to embodiments, there is provided a device and method for controlling a vehicle when an emergency vehicle approaches.

According to an embodiment, there may be provided a vehicle control device, comprising a receiving unit receiving emergency vehicle driving information including at least one of location information, path information, speed information, or driving lane information for an emergency vehicle, a driving lane identification unit extracting road information for a road on which a vehicle is driving using location information and map information for the vehicle and obtaining driving lane information for the vehicle based on sensor information obtained from a sensor of the vehicle, and a driving controller determining whether the emergency vehicle and the vehicle travel in the same lane using the emergency vehicle driving information and the driving lane information for the vehicle and controlling to vary at least one of a set speed value or a set inter-vehicle distance of a driving assist system applied to the vehicle and activated based on a result of the determination.

According to an embodiment, there may be provided a vehicle control method, comprising receiving emergency vehicle driving information including at least one of location information, path information, speed information, or driving lane information for an emergency vehicle, extracting lane information for a road on which a vehicle is driving using location information and map information for the vehicle and obtaining driving lane information for the vehicle based on sensor information obtained from a sensor of the vehicle, and controlling driving, including determining whether the emergency vehicle and the vehicle travel in the same lane using the emergency vehicle driving information and the driving lane information for the vehicle and controlling to vary at least one of a set speed value or a set inter-vehicle distance of a driving assist system applied to the vehicle and activated based on a result of the determination.

According to the embodiments, it is possible to provide a vehicle control device and method that enables the vehicle to efficiently yield to an emergency vehicle when the emergency vehicle approaches.

BRIEF DESCRIPTION OF THE DRAWINGS

The above and other objects, features, and advantages of the disclosure will be more clearly understood from the following detailed description, taken in conjunction with the accompanying drawings, in which.

DETAILED DESCRIPTION OF THE EXEMPLARY EMBODIMENTS

Figure 1:
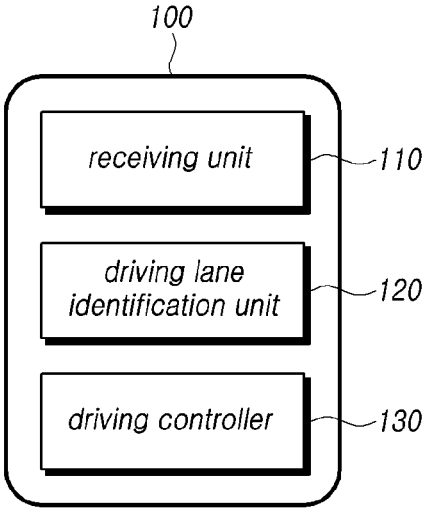
FIG. 1 is a view illustrating a configuration of a vehicle control device according to an embodiment of the disclosure.

The disclosure relates to a device and method for controlling a vehicle.

In the following description of examples or embodiments of the disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the disclosure, detailed descriptions of well-known functions and components incorporated herein will be omitted when it is determined that the description may make the subject matter in some embodiments of the disclosure rather unclear.

The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can". Terms used herein are described below.

As used herein, lane refers to one of areas on a road which are divided by lines to allow vehicles to travel therein in one line.

Emergency vehicle refers to a vehicle that may request the vehicle ahead to yield or may pass the vehicle ahead for driving in case of an emergency, such as an ambulance, a police car, or a fire truck. However, this is merely an example, and any target vehicle to which the disclosure is applicable may be such an emergency vehicle.

According to the disclosure, the vehicle control device may be used to control the driving assist system. Driving assist system refers to a system assisting the driver in driving the vehicle, such as a smart cruise control system, a forward collision warning system, an adaptive cruise control system, or a lane keeping assist system. The vehicle control device may control only the steering device or the brake device while the vehicle is running or may also control the vehicle to change lanes by controlling all of the in-vehicle devices necessary for driving the vehicle, including the steering device and the brake device. The vehicle control device may provide the driver with a proposed target lane or set values for the driving assist system through a display in the vehicle. The vehicle control device may also enable the vehicle to travel on the road in a proposed lane or according to set values for the driving assist system.

FIG. 1 is a view illustrating a configuration of a vehicle control device according to an embodiment of the disclosure.

Referring to FIG. 1, according to an embodiment of the disclosure, a vehicle control device 100 may include a receiving unit 110 receiving emergency vehicle driving information including at least one of location information, path information, speed information, or driving lane information for an emergency vehicle, a driving lane identification unit 120 extracting road information for a road on which a vehicle is driving using location information and map information for the vehicle and obtaining driving lane information for the vehicle based on sensor information obtained from a sensor of the vehicle, and a driving controller 130 determining whether the emergency vehicle and the vehicle travel in the same lane using the emergency vehicle driving information and the driving lane information for the vehicle and controlling to vary at least one of a speed or a set inter-vehicle distance of a driving assist system applied to the vehicle and activated based on a result of the determination.

According to an embodiment of the disclosure, the vehicle may receive the emergency vehicle driving information. For example, the vehicle may receive driving information for the emergency vehicle through the receiving unit 110 using V2X communication technology. However, without limitations to V2X communication technology, other various technologies may be applied for a vehicle to receive information from another vehicle (e.g., an emergency vehicle). For example, the receiving unit 110 may receive information, such as for the road infrastructure, traffic, or pedestrians around the road, through V2X communication which encompasses vehicle-to-vehicle (V2V) communication, vehicle-to-infrastructure (V2I) communication, intra-vehicle wired/wireless networking (IVN), and vehicle-to-pedestrian (V2P) communication.

As an example, the driving information may include at least one of path information according to the location information and destination information for the emergency vehicle, state information for the emergency vehicle, such as the speed, acceleration, and steering of the emergency vehicle, and driving road information, such as the type of road, number of lanes, and facilities. However, although the above-enumerated driving information is merely an example, the driving information is not limited thereto but may include at least one of information generated from the emergency vehicle or information received by the emergency vehicle.

The driving lane identification unit 120 may obtain road information for the road where the vehicle is driving and driving lane information for the lane in which the vehicle is actually driving. For example, the road information may include at least one of information for the number of lanes of the road where the vehicle is driving, lane width information, and driving road type information. As an example, the driving lane identification unit 120 may obtain the road information for the road where the vehicle is driving or the driving lane information for the vehicle by exchanging information with an internal or external device of the vehicle. The driving lane information for the vehicle may mean information for the specific lane of the road, in which the vehicle is driving, such as whether the vehicle is driving in a first lane or a second lane.

For example, the driving lane of the vehicle may be identified through V2X vehicle information data. Specifically, the driving lane of the vehicle may be identified by obtaining relative locations between vehicles using V2X communication. As another example, the driving lane of the vehicle may be identified by an external sensor in the vehicle as well. For example, the driving lane of the vehicle may also be identified using lane information detected by, e.g., a camera in the vehicle. However, without limitations thereto, other various methods may be applied as identifying the driving lane of the vehicle by an external sensor in the vehicle.

The driving controller 130 may determine whether the emergency vehicle and the vehicle travel in the same driving lane using the emergency vehicle driving information and the driving lane information for the vehicle. For example, the driving controller 130 may grasp the current location according to the path through the emergency vehicle driving information and grasp the current location of the vehicle based on the location information for the vehicle, thereby determining whether the emergency vehicle and the vehicle travel in the same lane Specifically, the driving controller 130 may determine whether the emergency vehicle and the vehicle travel in the same driving lane using, e.g., the distance between the emergency vehicle and the vehicle, vehicle information for the vehicles in front of, and behind, the emergency vehicle, and whether to enter the lane expected according to the direction to the destination of the emergency vehicle.

The driving controller 130 may determine a variable parameter of the driving assist system depending on the result of determining whether the emergency vehicle and the vehicle travel in the same lane. For example, the driving controller 130 may vary a parameter value set for the driving assist system to fit the context varied according to the driving information for the vehicle.

As an example, the driving controller 130 may vary a set speed for the driving assist system. The driving controller 130 may vary and provide the set speed for the driving assist system of the vehicle according to the approaching speed and approaching distance of the emergency vehicle based on the speed limit to the lane in which the vehicle is driving and the current driving speed of the vehicle.

As another example, the driving controller 130 may vary a set inter-vehicle distance for the driving assist system. For example, the driving assist system may calculate and provide a safe inter-vehicle distance depending on the speed of the vehicle and the road environment and, if the emergency vehicle approaches, the driving controller 130 may vary the set inter-vehicle distance. In other words, the vehicle which is in the driving lane of the emergency vehicle may enter a different lane to yield to the emergency vehicle, and the driving controller 130 may previously vary and provide the set inter-vehicle distance for vehicles so as to secure a sufficient space to allow the vehicle to move to the lane which the vehicle intends to enter.

As another example, the driving controller 130 may vary a set value for the collision-avoidance assist function of the driving assist system. For example, when the driving assist system performs braking control on the vehicle, the driving controller 130 may vary the operation sensitivity of the driving assist system. As a specific example, the driving controller 130 may previously notify the driver by, e.g., a warning sound through varying the set value for the collision-avoidance assist function and control to increase the maximum operation speed for emergency braking and collision warning.

The driving controller 130 may control to vary at least one of the above-described speed, inter-vehicle distance, and braking control value of the driving assist system.

An example driving assist system has been described above. The driving controller 130 may vary a diversity of parameters depending on the type of the driving assist system applied to the vehicle and activated. For example, the driving assist system means a cruise control system for controlling cruising to the preceding vehicle, an emergency braking system that performs braking in an emergency, a lane keeping assist system for keeping lane, or other various systems for assisting in driving.

As described above, if a cruise control system is applied to the vehicle and activated as an example, the driving controller 130 may set the inter-vehicle distance to the preceding vehicle and the speed of the host vehicle as parameters. The driving controller 130 may vary a set value for at least one parameter among the inter-vehicle distance and the vehicle speed based on whether the emergency vehicle and the host vehicle travel in the same lane using the above-described information. Similarly, if an emergency braking system, which performs braking control or warning control when a collision is expected so as to prevent the vehicle from forward collision, is activated, the driving controller 130 may vary a sensitivity value set for braking or warning control.

Although the inter-vehicle distance, speed, and sensitivity have been described above as example parameters, other parameter values may be varied depending on the type of the driving assist system activated in the vehicle.

Figure 2:
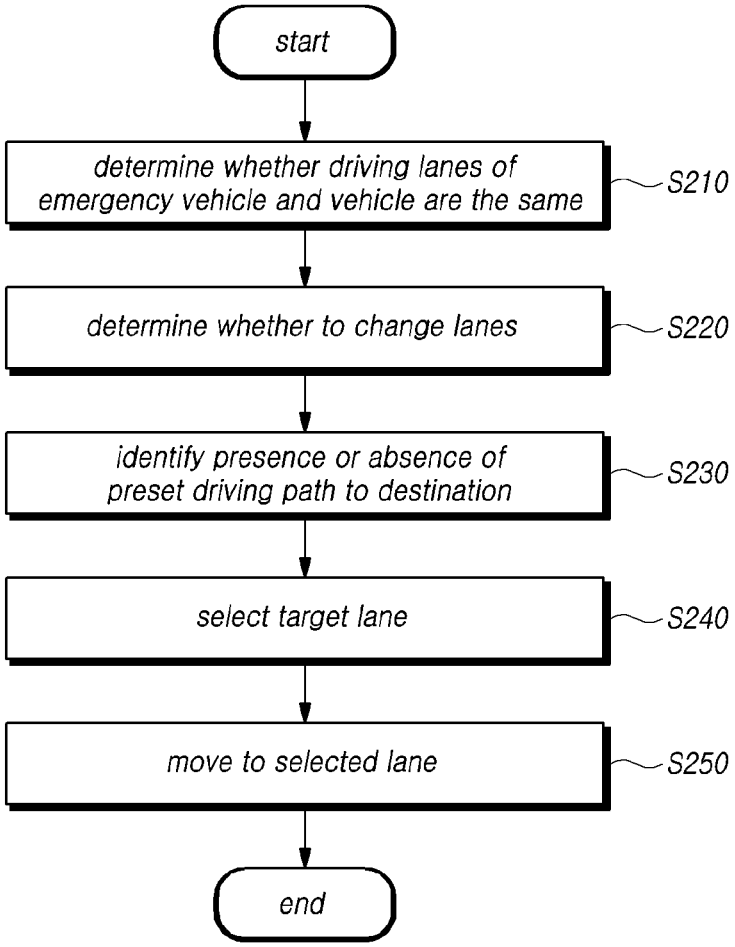
FIG. 2 is a flowchart illustrating an example in which a driving controller selects a lane to which a vehicle is to change and allows the vehicle to move according to an embodiment of the disclosure.

FIG. 2 is a flowchart illustrating an example in which a driving controller selects a lane to which a vehicle is to change and allows the vehicle to move according to an embodiment of the disclosure.

Referring to FIG. 2, according to an embodiment of the disclosure, the driving controller 130 may determine whether to change the lane of the vehicle and select a target lane to which the vehicle is to move.

The driving controller 130 determines whether the emergency vehicle and the vehicle travel in the same lane (S210). For example, as described above in connection with FIG. 1, the driving controller 130 may determine whether the emergency vehicle and the vehicle travel in the same lane using emergency vehicle driving information and driving lane information for the vehicle.

The driving controller 130 determines whether to change the lane of the vehicle based on the result of the determination (S220). For example, if the emergency vehicle and the vehicle travel in the same lane, vehicles in the driving lane of the emergency vehicle need to change lanes to allow the emergency vehicle to pass. Accordingly, if it is determined that the emergency vehicle and the vehicle travel in the same lane, the driving controller 130 may determine to change the driving lane of the vehicle.

If it is determined to change the lane, the driving controller 130 identifies whether a driving path to the destination is set in the vehicle (S230). For example, if a driving path to the destination is set in the vehicle, the driving controller 130 may consider the driving path in selecting a target lane. This is why an unintentional change in driving path may occur without considering the driving path when the driving lane of the vehicle is varied by the emergency vehicle. For example, in a case where the vehicle needs to change driving roads through a crossroads, such as a highway junction or interchange, within a predetermined distance, if the vehicle changes lanes to where the road is to be changed, the vehicle may have difficulty in driving along the driving path due to the emergency vehicle.

The driving controller 130 may select a target lane depending on whether there is a set driving path to the destination (S240). As an example, if there is no set driving path, the driving controller 130 may select the target lane to which the vehicle is to change using at least one of inter-vehicle distance information, speed information, or traffic information for an expected target lane.

As another example, if a driving path to the destination is set in the vehicle, the driving controller 130 may select a target lane considering whether the vehicle changes the road where it is driving within a predetermined distance based on the driving path. Specifically, when the vehicle changes the road where the vehicle is driving, the driving controller 130 may select a target lane based on the direction in which the road is changed. For example, the driving controller 130 may calculate a necessary distance within which the vehicle may change the road at a highway crossroads without difficulty depending on the speed of the vehicle. If it is determined that there is a vehicle within the calculated necessary distance, the driving controller 130 may further consider the direction in which the road is changed at the crossroads so that the vehicle may change the road at the crossroads. In other words, the driving controller 130 may select a target lane considering at least one of the inter-vehicle distance information for the expected target lane, speed information, or traffic information, and the information for the direction in which the road is changed. For example, in the case of an intersection, the driving controller 130 may calculate the distance corresponding to the functional influence zone of the intersection for the vehicle using, e.g., the distance necessary to decelerate while moving in the traverse direction and select the target lane based on the driving path of the vehicle within the calculated distance.

The driving controller 130 may control the vehicle to move to the selected target lane (S250). For example, the driving controller 130 may control the movement of the vehicle by generating or outputting a control signal for controlling, e.g., the steering, speed, or braking of the vehicle.

Figure 3:
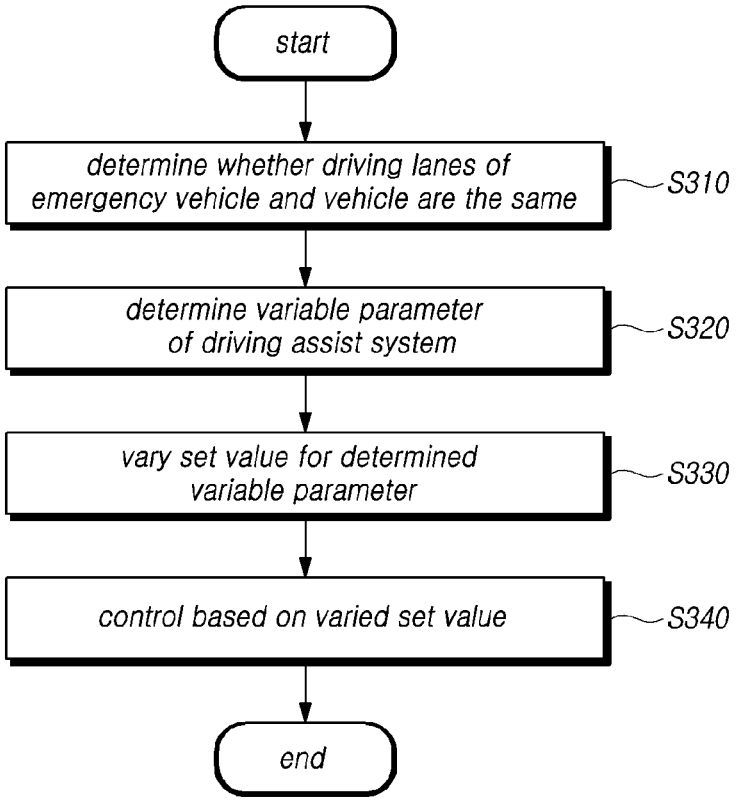
FIG. 3 is a flowchart illustrating an example in which a driving controller changes a variable parameter setting of a driving assist system and performs control according to an embodiment of the disclosure.

FIG. 3 is a flowchart illustrating an example in which a driving controller changes a variable parameter setting of a driving assist system and performs control according to an embodiment of the disclosure.

Referring to FIG. 3, according to an embodiment of the disclosure, the driving controller 130 determines whether the emergency vehicle and the vehicle travel in the same lane (S310). The driving controller 130 determines whether to change the lane of the vehicle based on the result of the determination. For example, if the emergency vehicle and the vehicle travel in the same lane, the driving controller 130 may change the driving lane of the vehicle. In contrast, unless the emergency vehicle and the vehicle travel in the same lane, the driving controller 130 may not change the driving lane of the vehicle. However, the driving controller 130 may control the vehicle, which is in the different driving lane from that of the emergency vehicle, to perform a specific operation. Operations of the driving controller 130 to control specific operations of a vehicle are described with reference to FIG. 3, under the assumption that the emergency vehicle and the vehicle travel in different lanes.

The driving controller 130 may determine a variable parameter of the driving assist system according to the driving lane of the vehicle (S320). The driving controller 130 may change the set value of the determined variable parameter (S330).

For example, the driving controller 130 may determine the variable parameter of the driving assist system applied to the vehicle and activated, as any one of a set speed and a set inter-vehicle distance, based on the driving lane difference value between the emergency vehicle and the vehicle. In other words, the driving controller 130 may determine which parameter of the driving assist system to change based on the lane spacing between the emergency vehicle and the vehicle.

For example, if it is determined that the driving lane of the vehicle is a lane adjacent to the driving lane of the emergency vehicle, the driving controller 130 may vary the set inter-vehicle distance of the driving assist system so as to secure a sufficient space for another vehicle ahead in the driving lane of the emergency vehicle to enter the driving lane of the vehicle based on, e.g., whether the driver of the other vehicle has an intent to change lanes, the possibility for the other vehicle to enter, and the inter-vehicle distance between the other vehicle and the vehicle. Even when the respective driving lanes of the emergency vehicle and the vehicle are adjacent to each other, the driving controller 130 may further control the set speed value.

As another example, if the driving lane of the vehicle is two lanes or more away from the driving lane of the emergency vehicle (that is, not adjacent to the driving lane of the emergency vehicle), the driving controller 130 may vary the set speed value of the driving assist system so as to avoid a likelihood of collision between the other vehicle and the vehicle due to the lane change. The driving controller 130 may also vary the set inter-vehicle distance even when the respective driving lanes of the emergency vehicle and the vehicle are not adjacent lanes.

As another example, the driving controller 130 may change variations in set inter-vehicle distance or set speed value based on the distance between the driving lanes of the vehicle and the emergency vehicle. For example, a first inter-vehicle distance that is varied when the vehicle travels in the lane adjacent to the driving lane of the emergency vehicle and a second inter-vehicle distance that is varied when the inter-lane difference is two or more lanes may be set to differ from each other. As an example, the first inter-vehicle distance may be set to be larger than the second inter-vehicle distance. As another example, the first inter-vehicle distance may be set to be smaller than the second inter-vehicle distance.

As another example, the driving controller 130 may set a first speed value that is varied when the vehicle travels in the lane adjacent to the driving lane of the emergency vehicle and a second speed value that is varied when the inter-lane difference is two or more lanes to differ from each other. As an example, the first speed value may be set to be smaller than the second speed value. As another example, the first speed value may be set to be larger than the second speed value.

An example operation for varying parameters when the driving assist system is a cruise control system has been described above. Other parameters may be varied depending on the type of the driving assist system.

In a case where the driving controller 130 determines the variable parameter of the driving assist system as the set inter-vehicle distance, the set inter-vehicle distance may be calculated as a distance necessary for the driver to detect a risk and operate the brake to stop the vehicle as a safety distance. For example, the set inter-vehicle distance may be calculated based on, e.g., the weight of each vehicle, the driving speed of each vehicle, the performance of brake-related devices of each vehicle, and the road condition. In other words, the driving controller 130 may calculate and vary the set inter-vehicle distance based on, e.g., vehicle information reflecting the context of the vehicles that intend to change lanes as an emergency vehicle approaches, road condition information, total length of vehicle, weight of vehicle, and performance of vehicle brake device.

In a case where the variable parameter of the driving assist system is determined as the set speed value, the set speed value may be calculated based on the inter-vehicle distance between the other vehicle and the vehicle, current driving speed, and the speed limit to the road on which it travels.

The driving controller 130 may change to the set value calculated according to the determined variable parameter of the driving assist system and perform control (S340).

Figure 4:
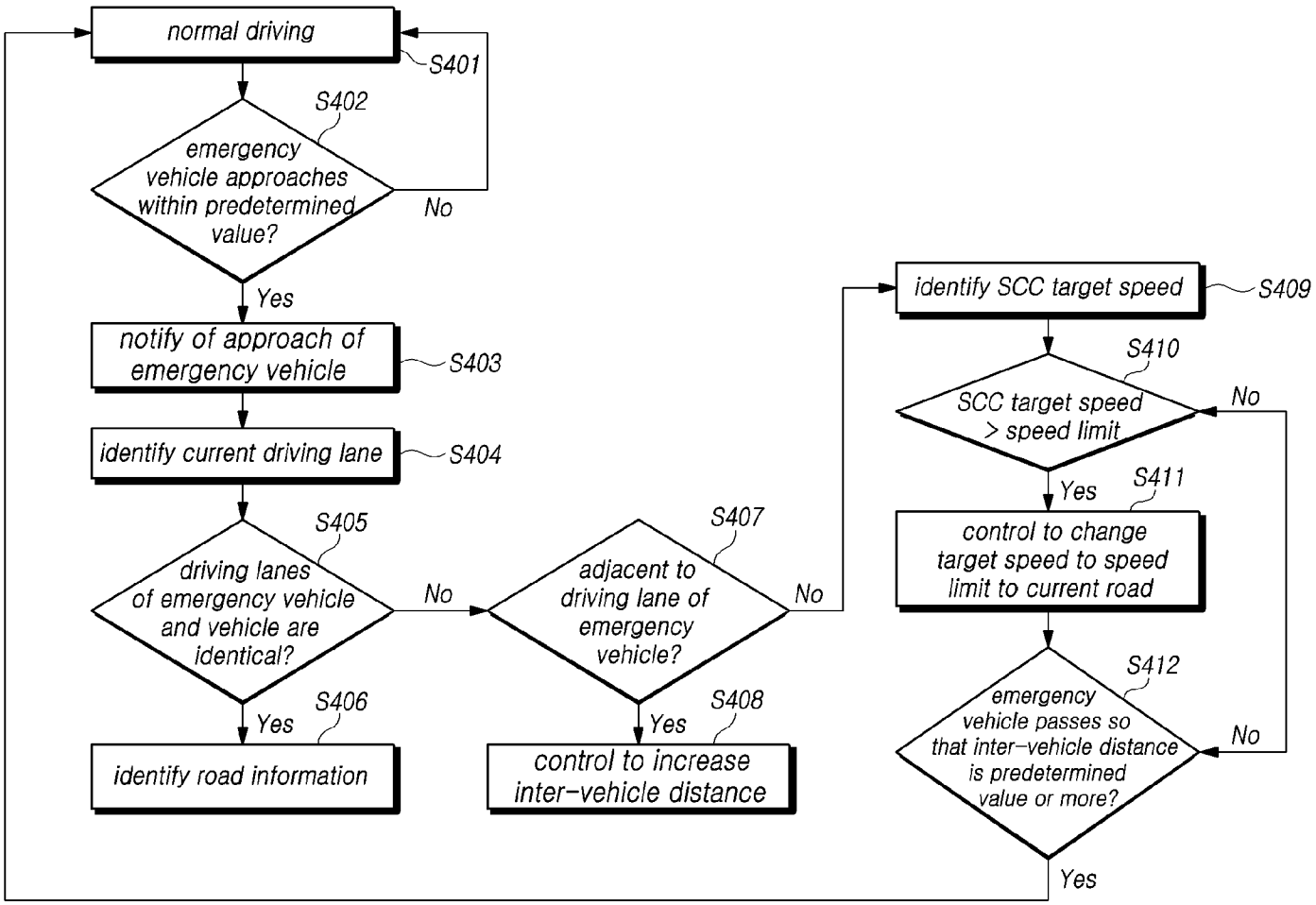
FIG. 4 is a flowchart illustrating the operation of controlling a vehicle in a case where a vehicle travels in a different lane when an emergency vehicle approaches according to an embodiment of the disclosure.

FIG. 4 is a flowchart illustrating the operation of controlling a vehicle in a case where a vehicle travels in a different lane when an emergency vehicle approaches according to an embodiment of the disclosure.

Example operations of a vehicle control device in a case where the driving lane of the emergency vehicle differs from the driving lane of the vehicle when the emergency vehicle approaches are described with reference to FIG. 4. Usually, the vehicle is normally traveling (S401). In this case, the smart cruise control system may be applied to the vehicle and activated as a driving assist system. The smart cruise control system refers to a driving assist system that follows the preceding vehicle while keeping a distance to the preceding vehicle by varying the speed. Although the smart cruise control system is described as the driving assist system as an example, embodiments of the disclosure may be likewise applied to other driving assist systems as described above.

Thereafter, if an emergency vehicle approaches and the vehicle is within a predetermined forward distance from the emergency vehicle (S402), the vehicle control device 100 provides an emergency vehicle approach notification (S403). For example, the vehicle which is within the predetermined forward distance from the emergency vehicle may receive emergency vehicle driving information through V2X communication with the emergency vehicle and receive road information and traffic signal information through a long-range wireless communication scheme (e.g., mobile communication (3G, 4G, or 5G) and may thus be previously notified of the approach of the emergency vehicle.

Then, the vehicle control device 100 identifies the current driving path of the vehicle receiving the notification (S404). For example, the vehicle control device 100 may directly obtain information for the lane in which the vehicle is actually traveling by, e.g., various sensors installed inside or outside the vehicle. However, this is merely an example, and embodiments of the disclosure are not limited thereto. The vehicle control device 100 compares the identified vehicle driving lane with the driving lane included in the emergency vehicle driving information received from the emergency vehicle and determines whether the driving lanes are the same (S405).

Next, if it is determined that the driving lane of the emergency vehicle and the driving lane of the vehicle are the same, the vehicle control device 100 identifies road information for the driving lane (S406). For example, the vehicle control device 100 may identify how many lanes the driving road has through the road information. The vehicle control device 100 may identify information, such as the type of road and the number of lanes, through the road information and enables the driving lane of the vehicle to differ from the driving lane of the emergency vehicle by using the identified information. This is described below in greater detail with reference to FIGS. 5 and 6.

In contrast, unless it is determined that the driving lane of the emergency vehicle is identical to the driving lane of the vehicle, the vehicle control device 100 determines whether the driving lane of the vehicle is adjacent to the driving lane of the emergency vehicle (S407).

The vehicle control device 100 may determine the variable parameter of the driving assist system of the vehicle as any one of a set speed value and a set inter-vehicle distance, depending on the result of determining whether the driving lane of the vehicle is adjacent to the driving lane of the emergency vehicle. Accordingly, the difference value between the driving lanes of the vehicle and the emergency vehicle needs to be calculated.

As an example, the driving lane difference value may be calculated by the number of lanes between the driving lane of the vehicle and the driving lane of the emergency vehicle. For example, if the vehicle is traveling in the first lane, and the emergency vehicle is traveling in the second lane, the driving lane difference value between the vehicle and the emergency vehicle may be 1. This means that the emergency vehicle is traveling in the very next lane to the vehicle.

As another example, the driving lane difference value may also be calculated by the distance between the driving lane of the vehicle and the driving lane of the emergency vehicle. For example, the driving lane difference value may be calculated based on the lateral separation distance between the vehicle and the emergency vehicle. To that end, information for the total number of lanes based on lane information for the driving, and the width of lane, distances to both lanes, and lane shape information, based on various types of sensor information for the vehicle may be used.

The vehicle control device 100 may determine the variable parameter to be varied based on the driving lane difference value between the vehicle and the emergency vehicle.

As an example, if the driving lane of the vehicle and the driving lane of the emergency vehicle are not the same but adjacent to each other (e.g., lanes next to each other), the vehicle control device 100 controls the vehicle to travel in a larger distance from the preceding vehicle in the driving lane of the vehicle (S408). For example, if the driving lane difference value between the emergency vehicle and the vehicle falls within a first reference range, the vehicle control device 100 may control to vary the set inter-vehicle distance of the driving assist system of the vehicle so that the set inter-vehicle distance increases. Various first reference ranges may be set depending on schemes of calculating the above-described driving lane difference value. As a specific example, the first reference range may be set so that the difference value is 1 as a range in which it is possible to specify the case where the vehicle and the emergency vehicle travel in lanes adjacent to each other. However, embodiments of the disclosure are not limited thereto.

If the driving lane of the vehicle and the driving lane of the emergency vehicle are not identical to each other nor are they adjacent to each other, the vehicle control device 100 identifies the set speed value of the driving assist system of the vehicle (S409). For example, if the driving lane difference value between the emergency vehicle and the vehicle falls within a second reference range, the vehicle control device 100 may control to vary the set speed value of the driving assist system of the vehicle so that the set speed value decreases. Various second reference ranges may be set depending on schemes of calculating the above-described driving lane difference value. As a specific example, the second reference range may be set so that the difference value is 2 or more as a range in which it is possible to specify the case where the vehicle and the emergency vehicle travel two lanes or more away from each other.

The vehicle control device 100 may compare a set target speed value with the speed limit to the current driving lane to thereby determine whether the set target speed value is larger than the speed limit to the current driving lane (S410) and, if the set speed value of the driving assist system of the vehicle is larger than the speed limit to the current driving lane of the vehicle, control to change the set speed value to the speed limit to the current driving lane (S411). For example, as other vehicles in front of the emergency vehicle change their driving lane to a next lane, lane changes of the vehicle frequently occur even when it travels in a lane away from the emergency vehicle. Accordingly, to avoid collision, the vehicle control device 100 may control to reduce the set speed value of the driving assist system of the vehicle based on, e.g., the inter-vehicle distance, current driving speed, congestion, and speed limit.

The vehicle control device 100 determines whether the emergency vehicle passes the vehicle so that the inter-vehicle distance from the vehicle is a predetermined value or more (S412). Thereafter, depending on a result of the determination, the vehicle control device 100 may control the vehicle to travel normally or to vary the set speed value of the driving assist system again. For example, if the emergency vehicle passes the vehicle but the inter-vehicle distance to the vehicle is not the predetermined value or more, the vehicle control device 100 may control to reduce the set speed value of the driving assist system of the vehicle.

Figure 5:
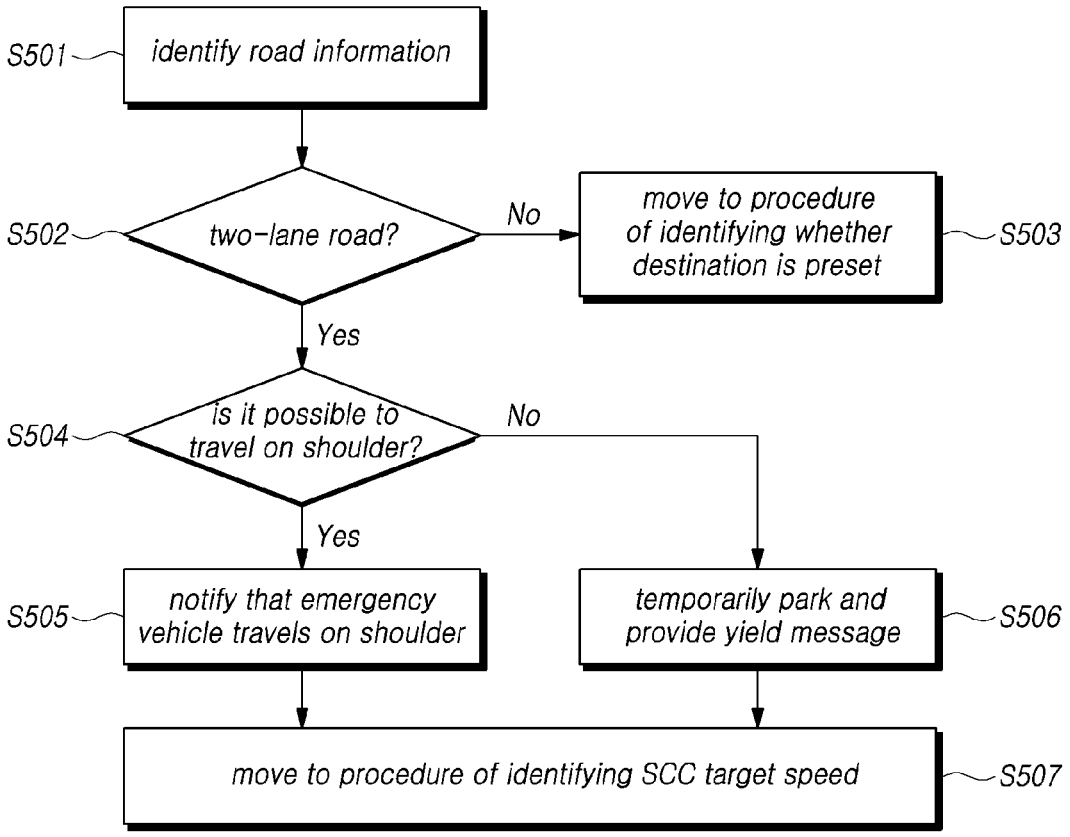
FIG. 5 is a flowchart illustrating the operation of controlling a vehicle using driving road information when an emergency vehicle approaches according to an embodiment of the disclosure.

FIG. 5 is a flowchart illustrating the operation of controlling a vehicle using driving road information when an emergency vehicle approaches according to an embodiment of the disclosure.

An example in which the vehicle control device 100 controls the vehicle traveling on a two-lane road as an emergency vehicle approaches is described below with reference to FIG. 5. As used herein, two-lane road refers to road with one lane in each direction.

If it is determined that the driving lanes of the vehicle and the emergency vehicle are the same using emergency vehicle driving information and driving lane information for the vehicle when the emergency vehicle approaches, the vehicle control device 100 identifies road information for the driving lane (S501). For example, the road information may mean, e.g., the type of road or the number of lanes.

The vehicle control device 100 identifies whether the road of the driving lane is a two-lane road (S502). For example, if the road is a two-lane road which has no other lane to which the vehicle is to move when the emergency vehicle approaches, the vehicle control device 100 may control the vehicle to temporarily park on one side of the road to allow the emergency vehicle to pass.

If the road on which the vehicle is traveling is not a two-lane road, the vehicle control device 100 proceeds with the procedure of identifying whether a path to the destination of the vehicle has been set (S503). This is described below in greater detail with reference to FIG. 6.

In contrast, if the road on which the vehicle is traveling is a two-lane road (e.g., a road with one lane in each direction), the vehicle control device 100 determines whether it is permitted to travel on the shoulder (or side road) (S504). For example, the vehicle control device 100 may determine whether it is permitted to travel on the shoulder using road condition information according to the current location of the vehicle so that the emergency vehicle may rapidly move. Specifically, the road condition information may mean, e.g., the presence or absence, width, length, or shape of the shoulder, road traffic, accelerable distance, and surrounding vehicles. As another example, the vehicle control device 100 may determine whether the road is one on which the emergency vehicle may travel on the shoulder or on which the vehicle may temporarily park in emergency based on the road condition information.

The vehicle control device 100 may control the emergency vehicle to travel on the shoulder based on a result of the determination. For example, if it is determined that the vehicle is able to travel on the shoulder based on the road condition information, the vehicle control device 100 may control to transmit a notification message indicating that such travel is possible, along with information regarding the shoulder, to the emergency vehicle.

In contrast, the vehicle control device 100 may control the vehicle to temporarily park on the shoulder and transmit a yield message based on a result of the determination (S506). For example, if it is determined that the vehicle may not travel on the shoulder based on the road condition information, the vehicle control device 100 may control the vehicle to temporarily park on the shoulder.

As another example, if it is determined that there is no shoulder, the vehicle control device 100 may determine which direction a space where it may park is located on the road based on map information, location information, and sensor information obtained from the sensors of the vehicle and control the vehicle to steer to the determined direction and temporarily park.

When the vehicle temporarily parks, the vehicle control device 100 may control to transmit a yield message indicating the temporarily parking to surrounding vehicles including the emergency vehicle.

Thereafter, the vehicle control device 100 proceeds with the procedure of identifying the set speed value of the driving assist system (S507). For example, if the emergency vehicle passes the vehicle but the inter-vehicle distance to the vehicle is not the predetermined value or more, the vehicle control device 100 may control to reduce the set speed value of the driving assist system of the vehicle.

Figure 6:
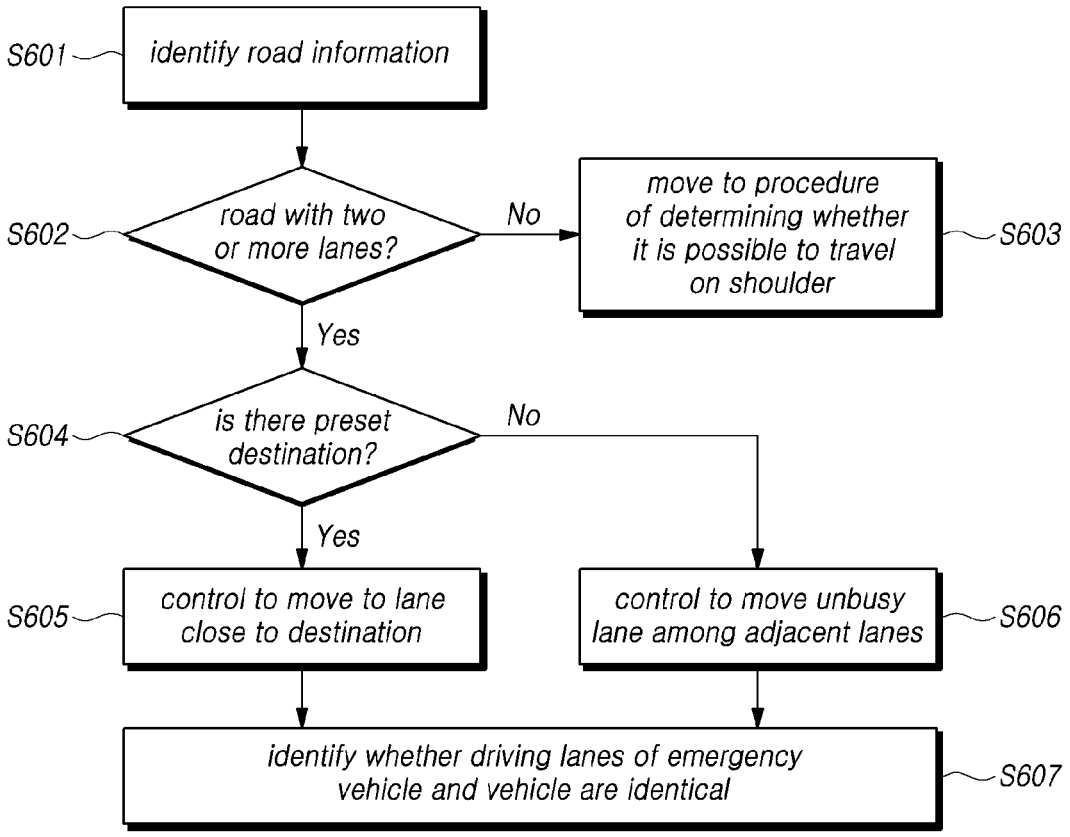
FIG. 6 is a flowchart illustrating the operation of controlling a vehicle using information for a driving path to a destination when an emergency vehicle approaches according to an embodiment of the disclosure.

FIG. 6 is a flowchart illustrating the operation of controlling a vehicle using information for a driving path to a destination when an emergency vehicle approaches according to an embodiment of the disclosure.

An example in which the vehicle control device 100 controls the vehicle depending on whether a driving path to the destination has been set as an emergency vehicle approaches is described below with reference to FIG. 6.

The vehicle control device 100 determines whether the driving lanes of the emergency vehicle and the vehicle are the same using emergency vehicle driving information and driving lane information for the vehicle when the emergency vehicle approaches. If it is determined that the driving lanes are the same, the vehicle control device 100 identifies road information for the driving lane (S601). For example, the road information may include, e.g., the type of road or the number of lanes.

The vehicle control device 100 identifies whether the road with the driving lane has two or more lanes in each direction (S602). If the road is a two-lane road, the vehicle control device 100 proceeds with the procedure of determining whether it is possible to travel on the shoulder (S603). It has been described above in detail with reference to FIG. 5.

In contrast, if the road has two or more lanes in each direction, the vehicle control device 100 determines whether a driving path to the destination has been set (S604). As another example, the vehicle control device 100 may determine whether a destination is input to the navigation device of the vehicle to thereby determine whether a driving path to the destination is set. As another example, if a driving path is set, the vehicle control device 100 may determine whether there is a plan to change the driving road depending on the driving path within a predetermined distance based on the current location of the vehicle.

If it is determined that a driving path to the destination is set, and the driving road is changed according to the driving path, the vehicle control device 100 may control the vehicle to move to a lane close to the target road (S605). For example, if it is determined that the vehicle changes the driving road within a predetermined distance based on the driving path, the vehicle control device 100 may control the vehicle to move to the lane close to the target road. As another example, the vehicle control device 100 may calculate a distance necessary to move to the target road based on speed information and the current lane location of the vehicle and control the vehicle to select and move in the target lane, with the driving path of the vehicle given priority, within the calculated distance.

The vehicle control device 100 may control the vehicle to move to an unbusy lane using at least one of the inter-vehicle distance information for the expected target lane, speed information, or traffic information (S606). For example, the vehicle control device 100 may control the vehicle to select an expected target lane in a direction along which a lane change is safe, based on the inter-vehicle distance, in the traverse direction, of the vehicles in the expected target lane, whether the vehicle in the expected target lane approaches, the congestion of the target lane, and the probability of collision according to the speed and acceleration of the vehicle and move to the selected lane.

As another example, the vehicle control device 100 may control the vehicle to select a lane and move to the selected lane using information related to the properties of the road. As an example, the vehicle control device 100 may control the vehicle to select, and move to, a target lane in a direction along which a lane change is safe, based on at least one of the speed limit, intersection, U-turn, road exit point (direction), road entry point (direction), roads merged point (direction), road split point (direction), or building access road.

After the lane change, the vehicle control device 100 may again perform the procedure of comparing the driving lanes of the emergency vehicle and the vehicle and determining whether the driving lanes are the same (S607). For example, if the vehicle changes the driving lane so that it is determined that the driving lane of the emergency vehicle and the driving lane of the vehicle are not the same, the vehicle control device 100 may control to vary at least one of the set speed value or set inter-vehicle distance of the driving assist system of the vehicle. As another example, if the driving lane of the vehicle is next to the driving lane of the emergency vehicle, the vehicle control device 100 may control the vehicle to broaden the inter-vehicle distance to the preceding vehicle in the driving lane of the vehicle and, if the set speed value of the driving assist system of the vehicle is larger than the speed limit to the current driving lane of the vehicle, control the vehicle to change the set speed value to the speed limit to the current driving lane.

Figure 7:
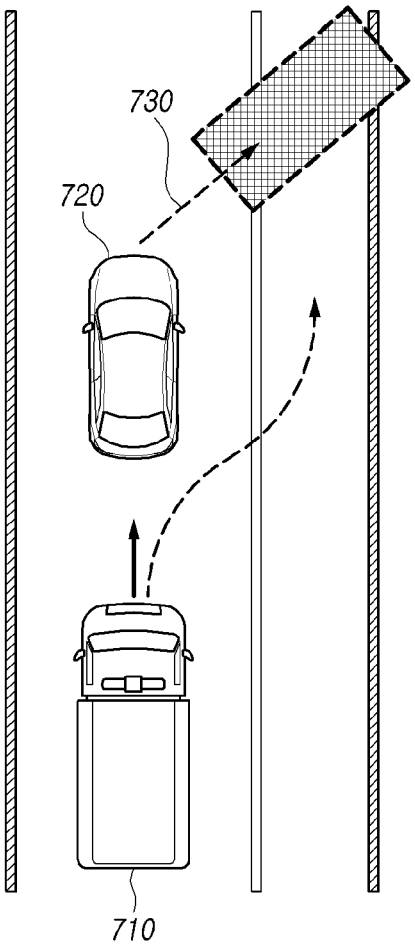
FIG. 7 is a view illustrating operations of a vehicle on a shoulder when an emergency vehicle approaches according to an embodiment of the disclosure.

FIG. 7 is a view illustrating operations of a vehicle on a shoulder when an emergency vehicle approaches according to an embodiment of the disclosure.

As an example, if an emergency vehicle 710 behind the vehicle approaches as illustrated in FIG. 7, the driving controller 130 of the vehicle 720 may obtain information on whether the road with the driving lane is a two-lane road and the road condition information according to the current location and determine whether the road is one in which the vehicle may travel on the shoulder. If it is determined that the vehicle may travel on the shoulder, the driving controller 130 may transmit a notification message indicating that it is possible to travel on the shoulder, along with information regarding the shoulder, to the emergency vehicle 710. Accordingly, the emergency vehicle 710 may move to the shoulder and pass the vehicle 720. In contrast, if it is determined that it is impossible to travel on the shoulder, the driving controller 130 controls the vehicle 720 to temporarily park (730) on the shoulder. Alternatively, the driving controller 130 may transmit a yield message indicating temporary parking to the emergency vehicle 710. Although should is exemplified in connection with FIG. 7, the above description may likewise be applied to variable lanes or parkable spaces outside the lane.

Figure 8:
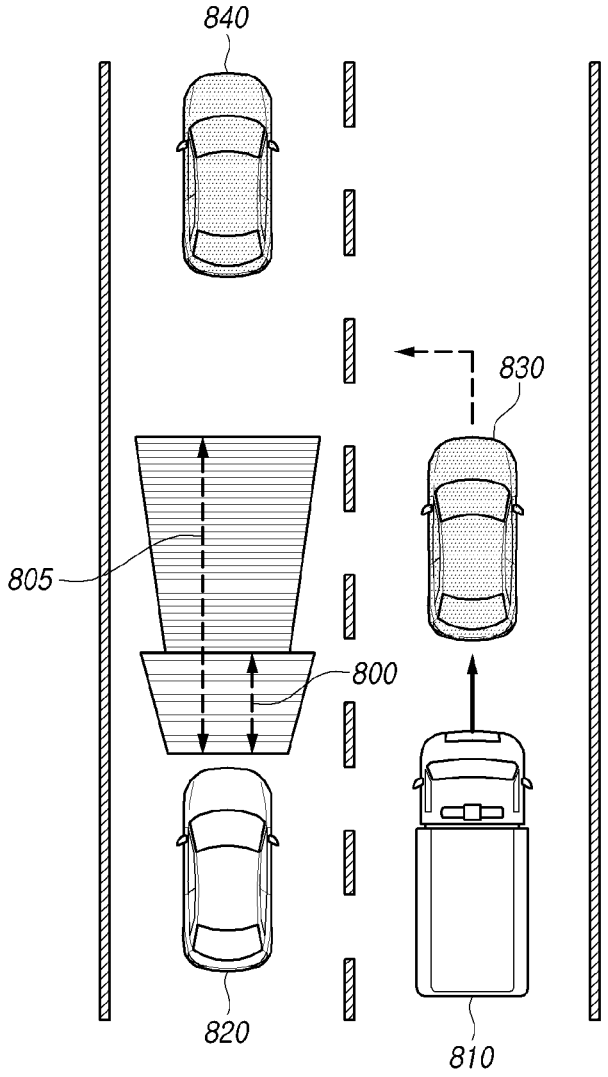
FIG. 8 is a view illustrating operations of a vehicle according to control of a set variable parameter value of a driving assist system as an emergency vehicle approaches according to an embodiment of the disclosure.

FIG. 8 is a view illustrating operations of a vehicle according to control of a set variable parameter value of a driving assist system as an emergency vehicle approaches according to an embodiment of the disclosure.

As an example, if it is determined that the driving lanes of an emergency vehicle 810 and a vehicle 820 are not the same as the emergency vehicle 810 approaches from behind the vehicle as illustrated in FIG. 8, the driving controller 130 of the vehicle 820 may determine the variable parameter of the driving assist system of the vehicle 820 as at least one of a set speed value or a set inter-vehicle distance and control to vary each set value. As set forth above, it may be determined based on the difference in distance in the traverse direction, width of lane, or driving lane difference value whether the driving lanes of the vehicle 820 and the emergency vehicle 810 are next to each other.

For example, if it is determined that the driving lane of the vehicle 820 is next to the driving lane of the emergency vehicle 810, the driving controller 130 may determine the variable parameter of the driving assist system of the vehicle 820 as the inter-vehicle distance, increase the existing set inter-vehicle distance 800 applied to the driving assist system and activated, and control the vehicle 820 to travel according to the varied set inter-vehicle distance 805.

As another example, if it is determined that the driving lane of the vehicle 820 is next to the driving lane of the emergency vehicle 810, the driving controller 130 may determine whether the preceding vehicle 830 changes lanes based on whether there is a preceding vehicle 830 traveling in the driving lane of the emergency vehicle, location, and speed. For example, if it is determined that the vehicle 830 ahead of the emergency vehicle is to move to the adjacent lane in which the vehicle 820 is traveling so as to yield to the emergency vehicle 810, the driving controller 130 may calculate the inter-vehicle distance between the vehicle 820 and the vehicle 840 ahead of the vehicle 820 based on the location and speed of the preceding vehicle 830. The driving controller 130 may control to increase the set inter-vehicle distance 805 of the driving assist system of the vehicle 820 using the calculated inter-vehicle distance.

As another example, if the set inter-vehicle distance of the driving assist system of the vehicle 820 is not less than an inter-vehicle distance within which the vehicle 830 ahead of the emergency vehicle may enter, the driving controller 130 may determine the variable parameter of the driving assist system of the vehicle 820 as the speed and control to reduce the set speed value.

Figure 9:
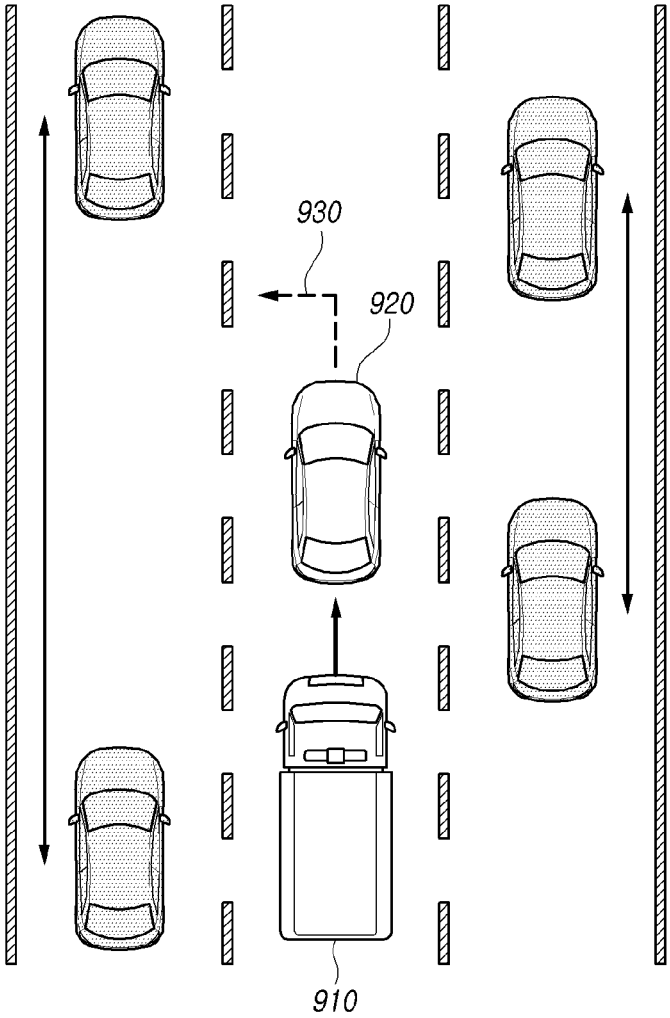
FIG. 9 is a view illustrating the operation of controlling a vehicle using driving lane information when an emergency vehicle approaches according to an embodiment of the disclosure.

FIG. 9 is a view illustrating the operation of controlling a vehicle using driving lane information when an emergency vehicle approaches according to an embodiment of the disclosure.

As an example, if an emergency vehicle 910 approaches from behind a vehicle 920, the driving controller 130 of the vehicle 920 determines whether the driving lanes of the emergency vehicle 910 and the vehicle 920 are the same. If it is determined that the driving lanes of the emergency vehicle 910 and the vehicle 920 are the same when the vehicle 920 travels in a road with three or more lanes, the driving controller 130 may control the vehicle 920 to select, and move to, a lane using information for an expected target lane, which is the lane on the left or right of the current driving lane of the vehicle 920.

For example, the driving controller 130 may use the inter-vehicle distance information for the expected target lane to select the target lane when the vehicle 920 travels on a road with three or more lanes. As an example, to prevent collision that may occur upon a lane change, the driving controller 130 may compare the inter-vehicle distance for the left lane with the inter-vehicle distance for the right lane and change (930) to the lane with the greater inter-vehicle distance.

As another example, the driving controller 130 may perform a lane change (930) by comparing the lanes based on the traffic in the expected target lane, average speed, occupancy, or other traffic information. The driving controller 130 may perform a lane change (930) by comparing the lanes based on whether there is a vehicle behind the vehicle in the expected target lane and, if any, the distance thereto, speed, and acceleration information, and information for the speed and acceleration of the vehicle 920.

Figure 10:
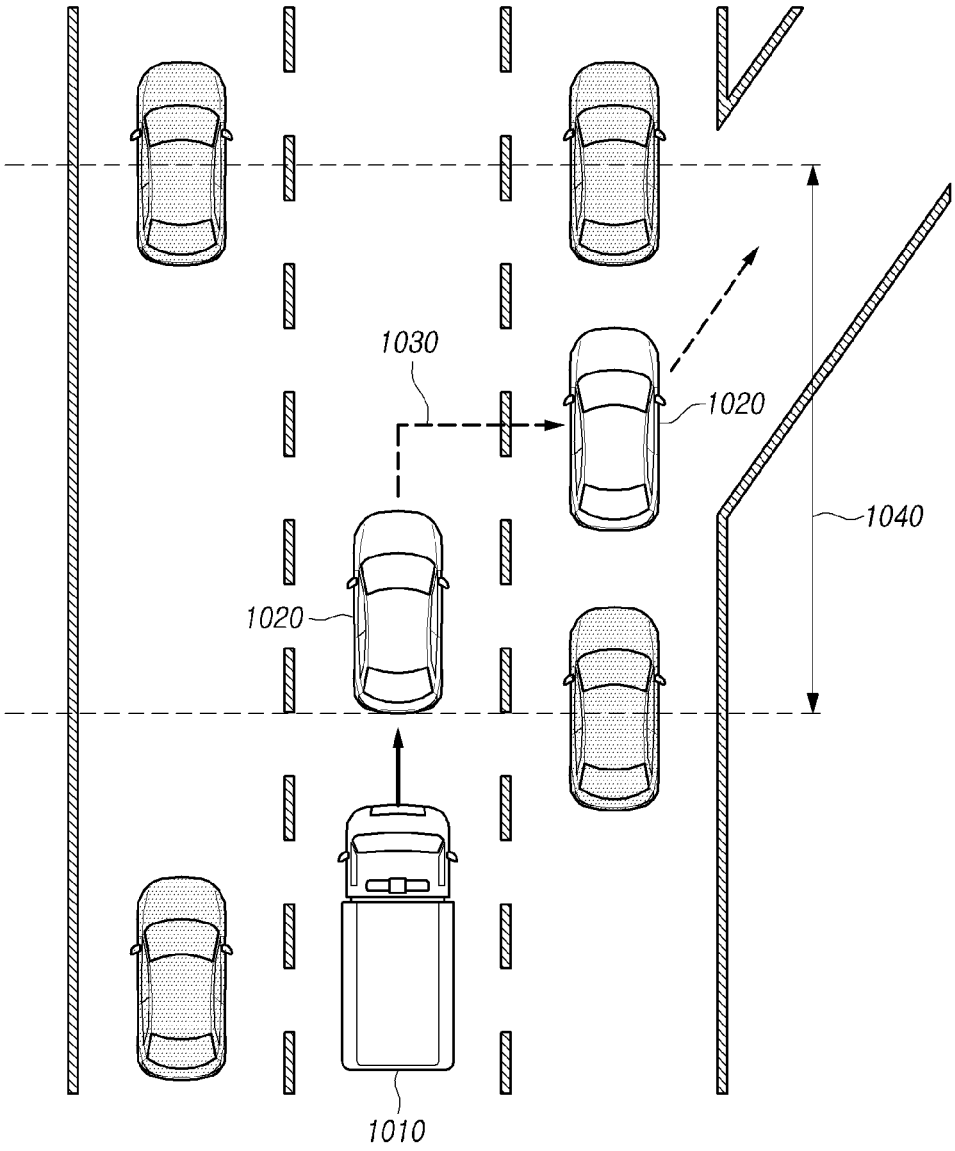
FIG. 10 is a view illustrating the operation of controlling a vehicle using information on whether there is a driving path to a destination when an emergency vehicle approaches according to an embodiment of the disclosure.

FIG. 10 is a view illustrating the operation of controlling a vehicle using information on whether there is a driving path to a destination when an emergency vehicle approaches according to an embodiment of the disclosure.

As an example, if it is determined that the driving lanes of an emergency vehicle 1010 and a vehicle 1020 are the same as illustrated in FIG. 10, the driving controller 130 of the vehicle 1020 may select a target lane depending on whether there is a plan to change the driving lane on the driving path set within a predetermined distance based on the current location of the vehicle in a case where the vehicle 1020 travels on a road with three or more lanes.

As a specific example, if there is a road change section, e.g., a highway junction, to the right of the vehicle 1020, and the vehicle is set to change lanes on the driving path of the vehicle 1020, the driving controller 130 may calculate the distance 1040 necessary to move to the target road based on speed information and the location of the current driving lane of the vehicle 1020. For example, although the necessary distance 1040 is shown to be a distance from the rearmost surface of the vehicle and the center of the target road, embodiments of the disclosure are not limited thereto. For example, the distance from the front of the vehicle to the point where the vehicle enters the branched road may be set as the necessary distance 1040, but is not limited thereto. If the vehicle 1020 is traveling within the calculated distance 1040, the driving controller 130 may control the vehicle 1020 to select, and move to, a target lane 1030 located in the direction along which the road change occurs, with the driving path of the vehicle given priority.

As another example, if a road change is not set on the driving path of the vehicle 1020 although there is a road change section, e.g., a highway junction, to the right of the vehicle 1020, the driving controller 130 may control the vehicle to select, and move to, a target lane using at least one of inter-vehicle distance information for the right or left lane of the driving lane of the vehicle, speed information, or traffic information. However, the driving controller 130 may determine a road that has the properties, such as an intersection, U-turn, road exit point, road entry point, roads merged point, road split point, or building access road, which has relatively heavy traffic, and select, and move to, the opposite lane as the target lane.

Figure 11:
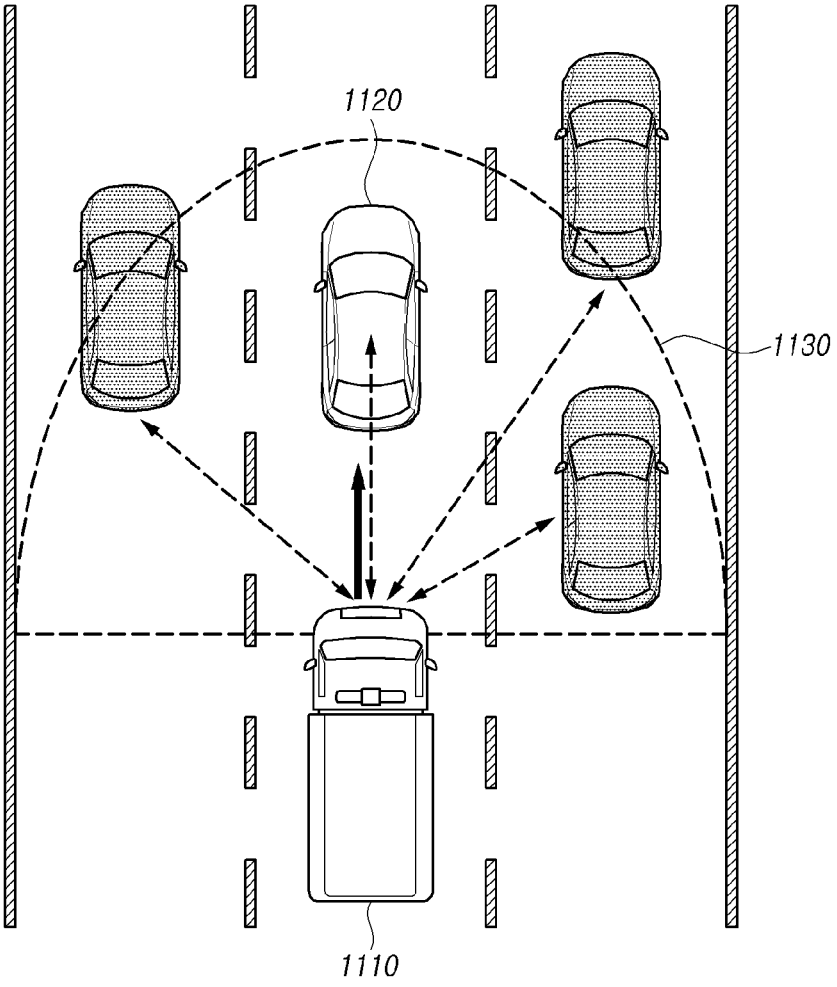
FIG. 11 is a view illustrating the operation of providing a notification to a vehicle when an emergency vehicle approaches according to an embodiment of the disclosure.

FIG. 11 is a view illustrating the operation of providing a notification to a vehicle when an emergency vehicle approaches according to an embodiment of the disclosure.

Referring to FIG. 11, the driving controller 130 may provide a notification if the vehicle is located ahead of the emergency vehicle 1110. As an example, when the emergency vehicle 1110 approaches from behind the vehicle 1120, the driving controller 130 calculates the inter-vehicle distance between the vehicle 1120 and the emergency vehicle 1110 and, if it is determined that the calculated inter-vehicle distance is a preset value 1130 or less, controls to provide a notification to the vehicle. For example, if the emergency vehicle 1110 approaches the vehicle 1120 within a distance not more than the preset value 1130, the driving controller 130 may receive a signal from the emergency vehicle 1110 and provide a notification to the driver using a voice notification, navigation, or terminal.

A vehicle control method that may be performed by the vehicle control device described above in connection with FIGS. 1 to 11 is described below.

Figure 12:
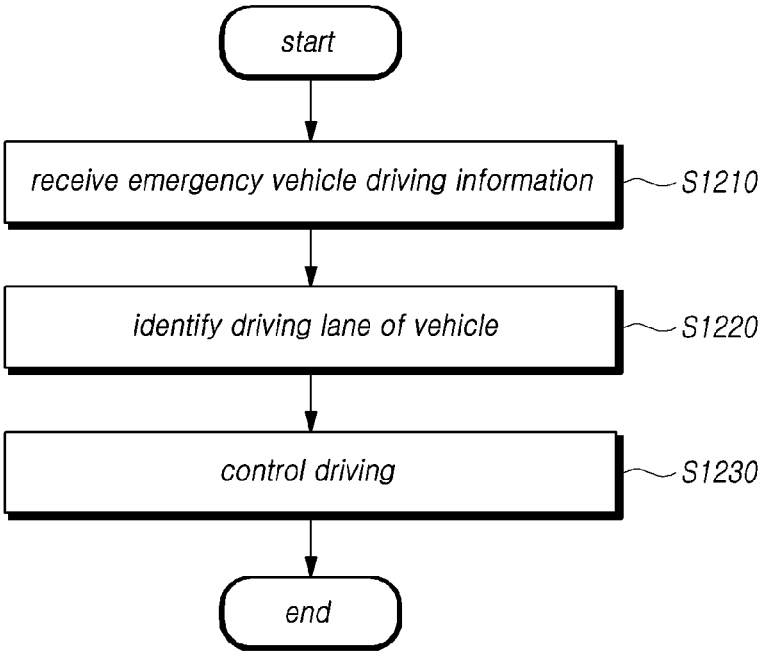
FIG. 12 is a flowchart illustrating a vehicle control method according to an embodiment of the disclosure.

FIG. 12 is a flowchart illustrating a vehicle control method according to an embodiment of the disclosure.

Referring to FIG. 12, according to the disclosure, a vehicle control method may include receiving emergency vehicle driving information (S1210). For example, the vehicle control device may receive emergency vehicle driving information including at least one of location information, path information, speed information, or driving lane information for an emergency vehicle.

The vehicle control method may include identifying a driving lane of the vehicle (S1220). For example, the vehicle control device may extract lane information for the road on which the vehicle is traveling using location information and map information for the vehicle and obtain driving lane information for the vehicle based on sensor information obtained from a sensor of the vehicle.

The vehicle control method may include controlling driving (S1230). For example, the vehicle control device may determine whether the emergency vehicle and the vehicle travel in the same lane using the emergency vehicle driving information and the driving lane information for the vehicle and control to vary at least one of a set speed value or a set inter-vehicle distance of a driving assist system applied to the vehicle and activated based on a result of the determination.

According to an embodiment, if it is determined that the emergency vehicle and the vehicle travel in the same lane, the vehicle control device may select a target lane to which the vehicle is to change the driving lane. For example, for the emergency vehicle to pass, the vehicles in the same driving lane need change lanes, and the vehicle control device may select a target lane to which the vehicle is to move. For example, if a driving path to the destination of the vehicle is preset, the vehicle control device may determine whether there is such an occasion where the driving road is changed within a predetermined distance in selecting a target lane to which the driving lane is to be changed and select the target lane based on the direction in which the driving road is changed according to a result of the determination. As another example, the vehicle control device may select a target lane to which the vehicle is to move using at least one of inter-vehicle distance information, speed information, or traffic information for the expected target lane.

According to an embodiment, if it is determined that the driving lanes of the emergency vehicle and the vehicle are not the same, the vehicle control device may determine the variable parameter of the driving assist system applied to the vehicle and activated, as at least one of a set speed value or a set inter-vehicle distance, based on the driving lane difference value between the emergency vehicle and the vehicle.

For example, if the driving lane difference value between the emergency vehicle and the vehicle falls within a preset first reference range, the vehicle control device may determine the variable parameter as the set inter-vehicle distance and control to increase the set inter-vehicle distance. If the difference value falls within a preset second reference range, the vehicle control device may determine the variable parameter as the set speed value and control to decrease the set speed value.

According to another embodiment, if it is determined that the driving lane of the vehicle is next to the driving lane of the emergency vehicle, the vehicle control device may control to increase the set inter-vehicle distance of the driving assist system applied to the vehicle and activated.

According to another embodiment, if it is determined that the driving lane of the vehicle is not the same as the driving lane of the emergency vehicle, the vehicle control device may control to decrease the set speed value of the driving assist system applied to the vehicle and activated.

For example, if the driving assist system applied to the vehicle and activated performs braking control on the vehicle, the vehicle control device may control to further vary the set operation sensitivity applied to the driving assist system.

As another example, the vehicle control device may calculate the inter-vehicle distance between the emergency vehicle and the vehicle and, if it is determined that the calculated inter-vehicle distance is a preset value or less, provide a notification to the vehicle ahead of the emergency vehicle.

As set forth above, according to the disclosure, there may be provided a vehicle control device and method as an emergency vehicle approaches. In particular, there may be provided a vehicle control device and method that allows an emergency vehicle to smoothly travel without disturbance by other vehicles by analyzing the location and driving lane of the emergency vehicle, providing a notification to vehicles in the same lane as the emergency vehicle according to a predetermined condition, allowing the vehicles to change their driving lane or to change preset variable parameter values of the driving assist system applied to the vehicle and activated.

The above description has been presented to enable any person skilled in the art to make and use the technical idea of the disclosure, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the disclosure. The above description and the accompanying drawings provide an example of the technical idea of the disclosure for illustrative purposes only. That is, the disclosed embodiments are intended to illustrate the scope of the technical idea of the disclosure. Thus, the scope of the disclosure is not limited to the embodiments shown, but is to be accorded the widest scope consistent with the claims. The scope of protection of the disclosure should be construed based on the following claims, and all technical ideas within the scope of equivalents thereof should be construed as being included within the scope of the disclosure.

What is claimed is:

1. A vehicle control device, comprising:

a receiving unit configured to receive emergency vehicle driving information including at least one of location information, path information, speed information, or driving lane information for an emergency vehicle;

a driving lane identification unit configured to extract road information for a road on which a vehicle is driving using location information and map information for the vehicle and obtain driving lane information for the vehicle based on sensor information obtained from a sensor of the vehicle; and a driving controller configured to determine whether the emergency vehicle and the vehicle travel in the same lane using the emergency vehicle driving information and the driving lane information for the vehicle and control to vary at least one of a set speed value or a set inter-vehicle distance of a driving assist system applied to the vehicle and activated based on a result of the determination, wherein when it is determined that the emergency vehicle and the vehicle travel in different lanes, the driving controller determines a variable parameter of the driving assist system applied to the vehicle and activated, as at least one of a set speed value or a set inter-vehicle distance, based on a driving lane difference value between the emergency vehicle and the vehicle, wherein when it is determined that the driving lane of the vehicle is a lane next to the driving lane of the emergency vehicle, the driving controller controls to increase the set inter-vehicle distance to a preceding vehicle in the driving lane of the driving assist system applied to the vehicle and activated, wherein when it is determined that the emergency vehicle and the vehicle travel in the same lane and a distance to a point where a driving road needs to be changed based on a set driving path in the vehicle is within a predetermined distance, the driving controller selects a target lane to be changed from the same lane, based on a direction in which the driving road is changed, and wherein a first inter-vehicle distance which is varied when the vehicle travels in the lane next to the driving lane of the emergency vehicle and a second inter-vehicle distance which is varied when the driving lane difference value is two or more lanes are set to differ from each other.

2. The vehicle control device of claim 1, wherein the driving controller selects the target lane to which the lane in which the vehicle is driving is to be changed using at least one of inter-vehicle distance information, speed information, or traffic information for an expected target lane.

3. The vehicle control device of claim 1, wherein the driving controller determines the variable parameter as the set inter-vehicle distance and controls to increase the set inter-vehicle distance if the difference value falls within a preset first reference range, and the driving controller determines the variable parameter as the set speed value and controls to decrease the set speed value if the difference value falls within a preset second reference range.

4. The vehicle control device of claim 1, wherein when it is determined that the emergency vehicle and the vehicle travel in different lanes, the driving controller controls to decrease a set speed value of the driving assist system applied to the vehicle and activated.

5. The vehicle control device of claim 1, wherein when the driving assist system applied to the vehicle and activated performs braking control on the vehicle, the driving controller controls to further vary a set operation sensitivity applied to the driving assist system.

6. The vehicle control device of claim 1, wherein the driving controller calculates a distance between the emergency vehicle and the vehicle and, if it is determined that the calculated distance is a set value or less, provides a notification to the vehicle in front of the emergency vehicle.

7. A vehicle control method, comprising:

receiving emergency vehicle driving information including at least one of location information, path information, speed information, or driving lane information for an emergency vehicle;

extracting lane information for a road on which a vehicle is driving using location information and map information for the vehicle and obtaining driving lane information for the vehicle based on sensor information obtained from a sensor of the vehicle; and controlling driving, including determining whether the emergency vehicle and the vehicle travel in the same lane using the emergency vehicle driving information and the driving lane information for the vehicle and controlling to vary at least one of a set speed value or a set inter-vehicle distance of a driving assist system applied to the vehicle and activated based on a result of the determination, wherein controlling the driving includes, when it is determined that the emergency vehicle and the vehicle travel in different lanes, determining a variable parameter of the driving assist system applied to the vehicle and activated, as at least one of a set speed value or a set inter-vehicle distance, based on a driving lane difference value between the emergency vehicle and the vehicle, and wherein controlling the driving includes, when it is determined that the driving lane of the vehicle is a lane next to the driving lane of the emergency vehicle, controlling to increase the set inter-vehicle distance to a preceding vehicle in the driving lane of the driving assist system applied to the vehicle and activated, and when it is determined that the emergency vehicle and the vehicle travel in the same lane and a distance to a point where a driving road needs to be changed based on a set driving path in the vehicle is within a predetermined distance, selecting a target lane to be changed from the same lane, based on a direction in which the driving road is changed, and wherein a first inter-vehicle distance which is varied when the vehicle travels in the lane next to the driving lane of the emergency vehicle and a second inter-vehicle distance which is varied when the driving lane difference value is two or more lanes are set to differ from each other.

8. The vehicle control method of claim 7, wherein controlling the driving includes:

determining the variable parameter as the set inter-vehicle distance and controls to increase the set inter-vehicle distance if the difference value falls within a preset first reference range; and determining the variable parameter as the set speed value and controls to decrease the set speed value if the difference value falls within a preset second reference range.

* * * * *